US008974187B2

(12) United States Patent
Neumann et al.

(10) Patent No.: US 8,974,187 B2
(45) Date of Patent: Mar. 10, 2015

(54) ROTOR BLADE AND FLOW ENGINE COMPRISING A ROTOR BLADE

(75) Inventors: Günter Neumann, Bochum (DE); Jörg Gatzke, Huenxe (DE); Ulrich Harbecke, Oberhausen (DE); Marc Andre Schwarz, Xanten (DE); Eduard Götzfried, Allersberg (DE)

(73) Assignee: MAN Diesel & Turbo SE, Augsburg (DE)

( * ) Notice: Subject to any disclaimer, the term of this patent is extended or adjusted under 35 U.S.C. 154(b) by 762 days.

(21) Appl. No.: 13/002,616

(22) PCT Filed: Jun. 24, 2009

(86) PCT No.: PCT/DE2009/000870

§ 371 (c)(1),
(2), (4) Date: Jan. 4, 2011

(87) PCT Pub. No.: WO2010/000228

PCT Pub. Date: Jan. 7, 2010

(65) Prior Publication Data

US 2011/0110786 A1 May 12, 2011

(30) Foreign Application Priority Data

Jul. 4, 2008 (DE) ..... 10 2008 031 780

(51) Int. Cl.
*F01D 5/30* (2006.01)

(52) U.S. Cl.
CPC ..... *F01D 5/3023* (2013.01); *F01D 5/3053* (2013.01); *F05D 2220/31* (2013.01)
USPC ..... 416/217; 416/222; 416/239

(58) Field of Classification Search
CPC ..... F01D 5/30; F01D 5/303; F01D 5/3023; F01D 5/3038; F01D 5/3046; F01D 5/3053
USPC ..... 416/215–218, 219 R, 220 R, 222, 239
See application file for complete search history.

(56) References Cited

U.S. PATENT DOCUMENTS 1,362,074 A * 12/1920 Baumann ..... 416/217
2,625,366 A * 1/1953 Williams ..... 416/92

(Continued)

FOREIGN PATENT DOCUMENTS

CN 1854465 4/2006
CN 101082287 12/2007

(Continued)

*Primary Examiner* — Edward Look
*Assistant Examiner* — Danielle M Christensen
(74) *Attorney, Agent, or Firm* — Cozen O'Connor

(57) ABSTRACT

A rotor blade for a flow machine, in particular a steam turbine, includes an insertion root with a first finger and two second fingers which are arranged on either side of the first finger in axial direction. The first finger and the second fingers have a shoulder in axial direction on axial sides facing one another such that the fingers have a radially outer first portion and a radially inner second portion whose axial extension is shorter than that of the outer, first portion. In relation to a total axial width between axial sides of the two second fingers which face away from one another, the radial height of the first, radially outer portion is in the range of 0.39 to 0.45, particularly 0.40 to 0.44, and the radial height of the second, radially inner portion is between 0.40 and 0.46, particularly between 0.41 and 0.45.

15 Claims, 4 Drawing Sheets

(56) References Cited

U.S. PATENT DOCUMENTS

| | | | | | |
|---|---|---|---|---|---|
| 2,790,620 | A | * | 4/1957 | Rankin | 416/217 |
| 4,321,012 | A | * | 3/1982 | Tan et al. | 416/217 |
| 5,062,769 | A | * | 11/1991 | Ortolano | 416/217 |
| 5,354,176 | A | * | 10/1994 | Schilling et al. | 416/204 R |
| 6,004,102 | A | | 12/1999 | Kuefner et al. | |
| 6,830,435 | B2 | * | 12/2004 | Goetzfried et al. | 416/189 |
| 2005/0047917 | A1 | * | 3/2005 | Brock et al. | 416/220 R |
| 2006/0245927 | A1 | * | 11/2006 | Yehle et al. | 416/219 R |
| 2008/0044286 | A1 | * | 2/2008 | Cortese et al. | 416/220 R |

FOREIGN PATENT DOCUMENTS

| | | | | |
|---|---|---|---|---|
| DE | 11 14 204 | | | 9/1961 |
| DE | 1114204 | B | * | 9/1961 |
| EP | 1 512 838 | | | 3/2005 |
| EP | 1 717 417 | | | 2/2006 |
| EP | 1 862 642 | | | 12/2007 |
| GB | 355 759 | | | 8/1931 |
| GB | 355759 | A | * | 8/1931 |
| GB | 2066904 | A | * | 7/1981 |
| JP | 2002 349 207 | | | 12/2002 |
| JP | 2007-321762 | | | 12/2007 |

* cited by examiner

ROTOR BLADE AND FLOW ENGINE COMPRISING A ROTOR BLADE

PRIORITY CLAIM

This is a U.S. national stage of Application No. PCT/DE2009/000870, filed on Jun. 24, 2009, which claims priority to German Application No: 10 2008 031 780.2, filed: Jul. 4, 2008, the contents of which are incorporated herein by reference.

BACKGROUND OF THE INVENTION

1. Field of the Invention

The present invention is directed to a rotor blade for a flow machine, in particular a steam turbine, comprising an insertion root with a plurality of fingers having radially outer first portions and radially inner second portions whose axial extension is shorter than that of the outer portions, and to a flow machine, particularly a steam turbine, having rotor blades of this kind.

2. Related Art

At present, besides rotor blades that are fixedly connected, e.g., welded, to the rotor of the flow machine, rotor blades with fir-tree turbine blade roots and insertion roots are commonly used, particularly in steam turbines. For example, Dubbel, Taschenbuch für den Maschinenbau, 20th edition, page R 67, shows a rotor blade for a steam turbine having a three-fingered insertion root, wherein the individual fingers have a shoulder on either axial side such that the fingers have a radially outer first portion and a radially inner second portion whose axial extension is shorter than that of the outer first portion.

Insertion roots of this type must withstand high stresses in operation. For one, large centrifugal forces acting in radial direction occur particularly at higher rotor speeds. Further, the medium which flows around, and is deflected by, the rotor blades, e.g., the steam which performs the work and is expanded in a steam turbine, exerts forces in axial direction and circumferential direction on the rotor blades which must be supported in the insertion roots.

SUMMARY OF THE INVENTION

It is an object of the present invention to improve the fastening of rotor blades of flow machines by insertion root.

The insertion root of a rotor blade according to one embodiment of the invention has a first finger and two second fingers that are arranged on either side of this first finger in axial direction. In particular, the insertion root can be three-fingered, in which case the first finger forms a center finger and the two second fingers form peripheral fingers. However, additional fingers can also be provided on one or both axial sides of a first finger or second finger, in which case these additional fingers are preferably formed like the first or second finger with respect to their basic geometric dimensioning.

According to one embodiment of the invention, the axial sides of the first finger and second finger facing one another have a shoulder that extends in axial direction in such a way that the fingers have a radially outer first portion and a radially inner second portion connected to the latter by the shoulder and whose extension in axial direction is shorter than that of the first, outer portion. The axial sides of the second finger which face away from one another preferably do not have a shoulder but rather form continuous, preferably planar, axial faces. Accordingly, in the case of a three-fingered insertion root, the center finger has a shoulder on both of its axial sides, and the two peripheral fingers only have a shoulder on their inner axial sides facing the center finger.

The present invention is based at least in part on the insight that the forces that can be absorbed by an insertion root of this kind can be appreciably increased through suitable selection of the radial height of the first portion and second portion in relation to a total axial width of the insertion root.

Total axial width is meant herein to be the distance between the axially outer faces of the two second fingers. If these two axial faces are not parallel, total axial width can be based in particular on a minimum, maximum or mean distance in axial direction. "Axial", "radial" and "circumferential" directions are meant herein as the directions for rotors in flow machines when the rotor blade according to the invention is fastened in a rotor of this kind.

According to one embodiment of the invention, it is proposed that the ratio of the radial height of the first, radially outer portion to the total axial width is in the range of 0.39 to 0.45, preferably 0.40 to 0.44, while the ratio of the radial height of the second, radially inner portion to the total axial width is between 0.40 and 0.46, preferably between 0.41 and 0.45. The radial height of a first, radially outer portion is, in particular, the radial extension between the shoulder and a web that connects a first finger to a second finger in axial direction. Correspondingly, by radial height of a second, radially inner portion is meant in particular the radial extension between the shoulder and a radially inner front side of the finger. Accordingly, when a radial extension varies in axial direction, e.g., because a radial front side, the shoulder and/or a web joining two adjacent fingers does not extend in axial direction parallel to the axial direction, radial height can be based particularly on a minimum, maximum or mean radial extension.

A ratio of a total radial height of the fingers to the total axial width is preferably in the range of 0.88 to 0.94, preferably 0.89 to 0.93. Total radial height is the sum of the above-defined radial heights of the first portion and second portion plus a radial height of the shoulder. This shoulder can be a strictly radial shoulder so that the axial extension of a finger between a first area and a second area changes abruptly or within a very short radial portion, i.e., the shoulder has a radial height substantially equal to zero. In this case, the total radial height can correspond to the sum of the radial heights of the first portion and second portion. However, the shoulder can also have a slope so that the axial width of the finger between the first portion and second portion narrows linearly. Other shoulders, particularly convex or concave shoulders, are also possible.

In accordance with the above-mentioned preferred ranges of the radial heights of the first portion and second portion and of the total radial height with respect to the total axial width, a shoulder has a preferred ratio of radial height to total axial width in the range of 0.00 to 0.14, preferably 0.00 to 0.12.

The first, radially outer portion and the second, radially inner portion of a first finger preferably have a ratio with respect to the total axial width of between 0.21 and 0.27, preferably between 0.22 and 0.26, and between 0.11 and 0.17, preferably between 0.12 and 0.16, respectively. The axial extensions of the first portion and second portion of a second finger are in a ratio to the total axial width of from 0.16 to 0.22, preferably from 0.17 to 0.21, and in a ratio from 0.11 to 0.17, preferably from 0.12 to 0.16, respectively.

The two axial sides of a finger are preferably formed parallel to one another. If this is not the case, the axial extension can be based in particular on a minimum, maximum, or mean distance between the two axial sides.

To fasten the insertion root in a groove arrangement provided for this purpose in the rotor of the flow machine, the first finger and the second fingers preferably have a bore hole, preferably two or more radially spaced bore holes which are aligned with one another so that a bolt, preferably a conical bolt, can be driven into them. To prevent manufacturing tolerances and assembly tolerances, these bore holes can also be drilled and/or ground after the insertion roots have been inserted into the groove arrangements.

The positions of the bolts are preferably selected in such that the centrifugal force load in an upper crack cross section of the bolt plane brings about only small bending loads, if any. The center of a radially outer bore hole preferably has a radial distance from the radially outer end of the first portion, for example, the radially inner front side of a web joining a first finger and second finger, having a ratio to the total axial width of between 0.24 and 0.30, preferably between 0.25 and 0.29, while the center of a radially inner bore hole has a corresponding ratio between 0.60 and 0.66, preferably between 0.61 and 0.65.

As was mentioned above, the first finger and the second finger are preferably connected to one another by a radially outer web in which the first portions of the fingers terminate radially. First fingers, second fingers and/or web can be formed integral with one another, particularly by primary casting and/or non-cutting or cutting machining, or can be formed of multiple pieces and connected, e.g., welded, to one another. The radially outer web preferably has a radial height whose ratio to the total axial width is in a range between 0.12 and 0.18, preferably between 0.13 and 0.17.

A front axial face of a second finger with reference to the rotating direction of the rotor when the rotor blade is mounted is preferably arranged parallel to the radial plane of the bore holes so that the rear axial face of the insertion root with reference to the rotating direction is turned around a blade pitch in a corresponding manner.

The web on which the rotor blade profile is arranged on the side lying opposite the insertion root preferably lies in a plane is substantially perpendicular to this radial plane through the boreholes. To this end, a radially inner front side and/or radially outer front side of the web can be formed substantially perpendicular to the radial plane of the bore holes, i.e., the plane extending in radial direction through the two center points of the bore holes.

A flow machine according to the present invention has a corresponding groove arrangement for fastening each rotor blade according to the invention, this groove arrangement having a first groove for receiving the first finger and two second grooves for receiving the second finger, these second grooves being separated from the first grooves by a web in each instance.

The grooves are preferably substantially complementary to the fingers received by them, and the preceding description is referred to in this regard. In particular, the total axial width between axial sides of the two second grooves facing away from one another preferably substantially corresponds to the total axial width between axial sides of the two second fingers facing away from one another.

In this respect, slight differences can be advantageous particularly for compensation of manufacturing tolerances and/or assembly tolerances. As was mentioned above with respect to the fingers, the radial heights and axial extensions can be based on maximum, minimum, or mean distances in radial and axial direction between parallel or non-parallel surfaces in a corresponding manner.

In one embodiment the ratio of the radial height of the first, radially outer web portion and of a first, radially outer groove portion, respectively, to the total axis width is preferably in a range between 0.40 and 0.46, preferably between 0.41 and 0.45, while the corresponding ratio of the radial height of the second, radially inner web portion and of a corresponding radially inner groove portion, respectively, to the total axial width is preferably between 0.44 and 0.50, preferably between 0.45 and 0.49.

BRIEF DESCRIPTION OF DRAWINGS

Other advantages and features are indicated in the dependent claims and the embodiment example. The partially schematic drawings show:

DETAILED DESCRIPTION OF THE DRAWINGS

Figure 1:
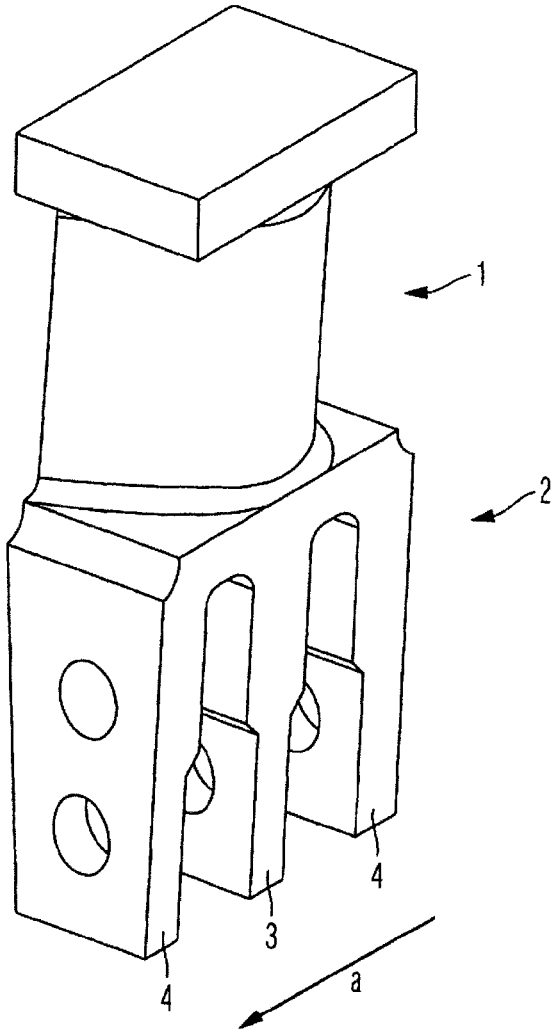
FIG. 1 is a general perspective view of a rotor blade according to one embodiment of the present invention.
Figure 2:
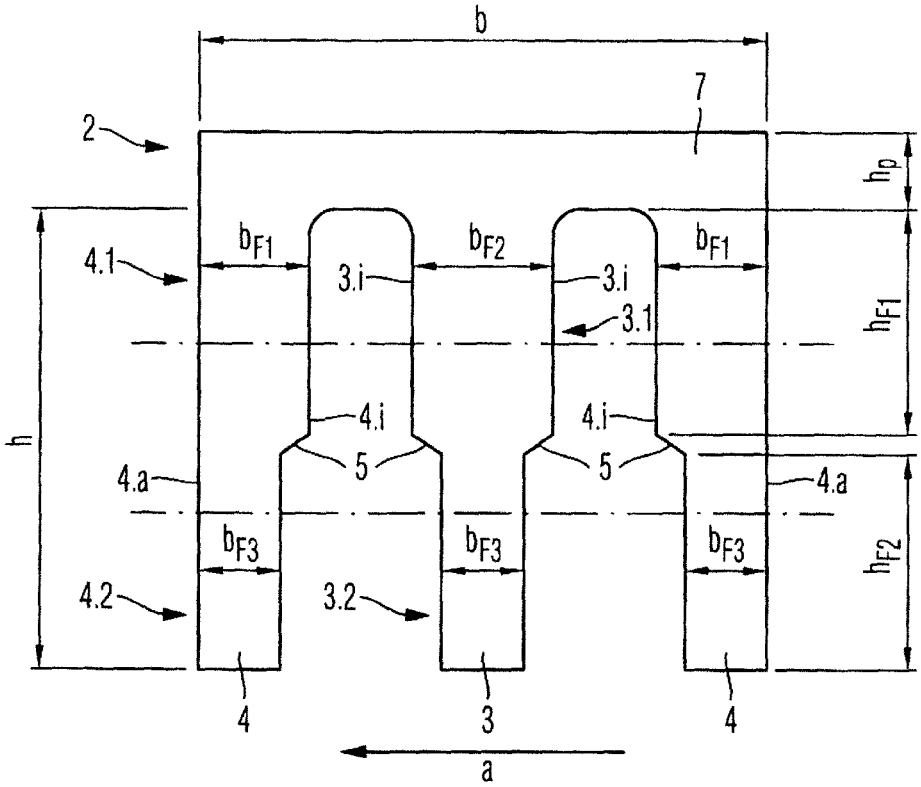
FIG. 2 is a top view of the insertion root of the rotor blade according to FIG. 1 in circumferential direction.

FIG. 1 is a perspective view of a rotor blade 1 with a three-fingered insertion root 2 according to a construction of the present invention. As can be seen particularly from FIG. 2, which shows a top view of the insertion root 2 in circumferential direction of a rotor of a steam turbine (not shown) into which the insertion root 2 can be inserted from the outside in radial direction, the three-fingered insertion root has a first center finger 3 and two second peripheral fingers 4 arranged in axial direction a on both sides of this center finger 3. The inner axial sides 3.*i* of the center finger 3 and the inner axial sides 4.*i* of the peripheral fingers 4 each have a sloping shoulder 5, while the axially outer faces 4.*a* of the two peripheral fingers 4 are planar and parallel to one another. A web 7, with which the center finger 3 and peripheral fingers 4 are formed, and the sloping shoulder 5, the center finger 3 has a first portion 3.1 with an axial extension $b_{F2}$, and the two peripheral fingers 4 each have a first portion 4.1 with an axial extension $b_{F1}$. These first portions have a radial height $h_{F1}$ as measured from the radially inner face (at bottom in FIG. 2) of the web 7 to the shoulder 5, i.e., to the location where the axial extension is reduced. The web 7 has a radial height $h_P$ between the radially outer end of the fingers 3, 4 and a radially outer front side located opposite the latter.

The center finger 3 and peripheral fingers 4 each have a second portion 3.2 and 4.2, respectively, separated from the first portion by the shoulder 5 and which has an axial extension $b_{F3}$ and a radial height $h_{F2}$ between a radially inner front side of the fingers and the shoulder 5, i.e., the area in which the axial extension changes, and an overall axial extension h.

The inner axial sides 3.*i*, 4.*i* of the fingers 3, 4 which face one another are formed, except for the sloping shoulder 5, parallel to the planar, shoulderless faces 4.*a* of the two peripheral fingers.

Between the two axial faces 4.*a* of the two peripheral fingers 4, the insertion root 2 has an axial width b in axial direction a. With respect to this total axial width b, a total radial height h of the insertion root extending between the radially inner front side of the web 7 and the radially inner front sides of the fingers 3, 4 has a ratio of:

$$h/b=0.91.$$

The ratios of the radial heights of the first and second fingers defined above are uniformly:

$h_{F1}/b=0.42$ and $h_{F2}/b=0.43$, respectively.

The axial extensions are:

$b_{F2}/b=0.24$ and $b_{F3}/b=0.14$ for the center finger 3, and $b_{F1}/b=0.19$ for the peripheral fingers 4, and $b_{F3}/b=0.14$ for the center finger.

Figure 3:
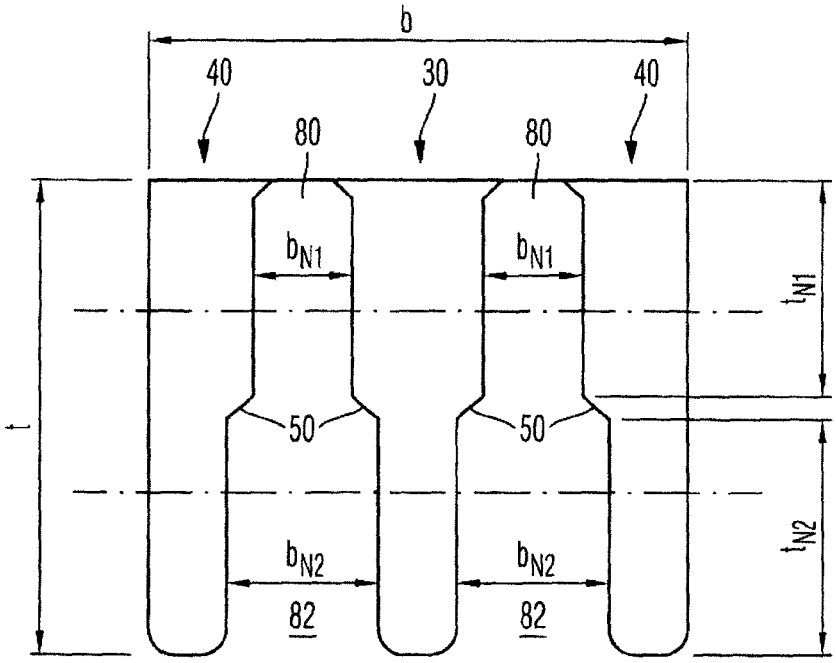
FIG. 3 is a groove arrangement for receiving the insertion root according to FIG. 2 in a view corresponding to FIG. 2.

The groove arrangement shown in FIG. 3 with a center groove 30 for receiving the center finger 3 and two peripheral grooves 40 for receiving the peripheral fingers 4 is formed in the rotor of the steam turbine for receiving this insertion root 2.

Figure 4:
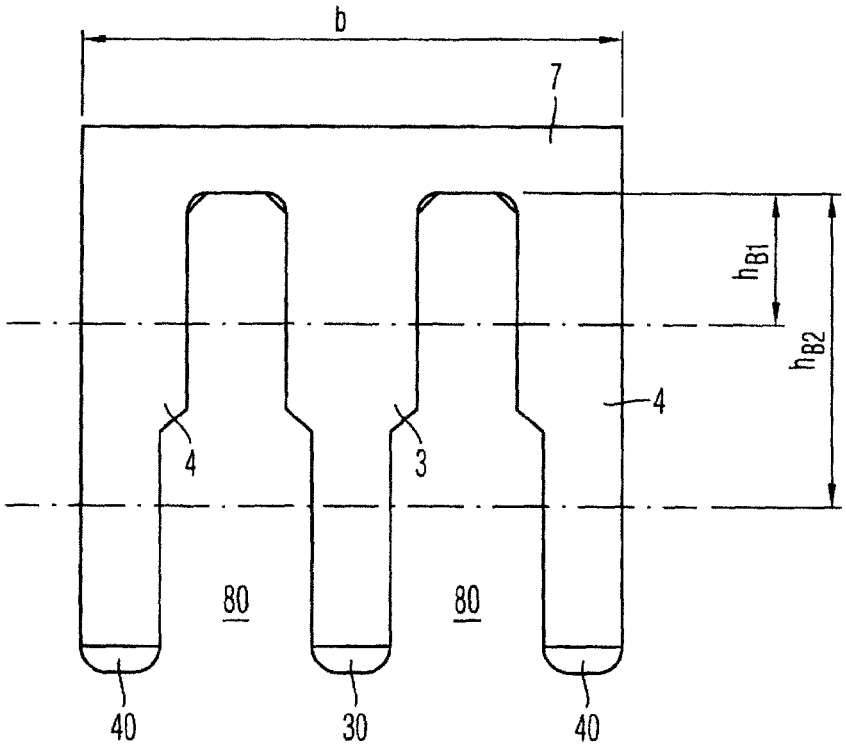
FIG. 4 is the insertion root according to FIG. 2 that is received in the groove arrangement according to FIG. 3.

As can be seen particularly from the general assembly diagram in FIGS. 3 and 4, the fingers 3, 4 and the grooves 30, 40 are formed substantially so as to complement one another. To this end, the groove arrangement has two identical webs 80, each of which has a second portion 82 proceeding from a radially inner groove base, which second portion 82 has an axial extension $b_{N2}$ which passes into a sloping shoulder 50 in a first portion with an axial extension $b_{N1}$. In relation to the total axial width b between the planar, parallel outer axial sides of the two peripheral grooves 40 which corresponds to the total axial width b between the two axial front sides 4.*a* of the peripheral fingers 4, the radial heights $t_{N1}$, $t_{N2}$ and axial extensions $b_{N1}$, $b_{N2}$, respectively, of this first portion and second portion are:

$b_{N1}/b$ *is in a range between* 0.16 and 0.22, preferably, $b_{N1}/b=0.19$, $b_{2N}$/b is in a range between 0.26 and 0.32, preferably, $b_{N2}/b=0.29$, $t_{N1}/b=0.43$, and $t_{N2}/b=0.47$.

The ratio of the total radial height t, which is given by the sum of the radial heights $t_{N1}$; $t_{N2}$ of the first portion and second portion and the radial height of the shoulder 50, to the total axial width b is in a range between 0.92 and 0.98, and preferably: t/b=0.95.

As can be seen particularly from FIGS. 3 and 4, the grooves 30, 40 have rounded bevels in their radially inner groove base, while the webs 40 have inclined bevels at their radially outer front sides.

As soon as the insertion root 2 has been inserted into the groove arrangement, it is fastened by two conical bolts (not shown) that are driven in an axial direction. Two bore holes 6.1, 6.2 shown in FIGS. 1 and 5 which extend through the fingers 3, 4 are provided for this purpose.

As can be seen particularly from FIG. 4, in which the center lines of the two bolts are shown in dash-dot lines, the center of the radially upper bore hole has a distance $h_{B1}$ from the radially outer front side of the webs 80 and the radially inner front side of the web 7, and the center line of the radially inner bore hole 6.2 which is likewise shown in dash-dot lines in FIG. 4 has a radial distance $h_{B2}$. Its ratio to the total axial width b is:

$h_{B1}/b=0.27$, $h_{B2}/b=0.63$.

Figure 5:
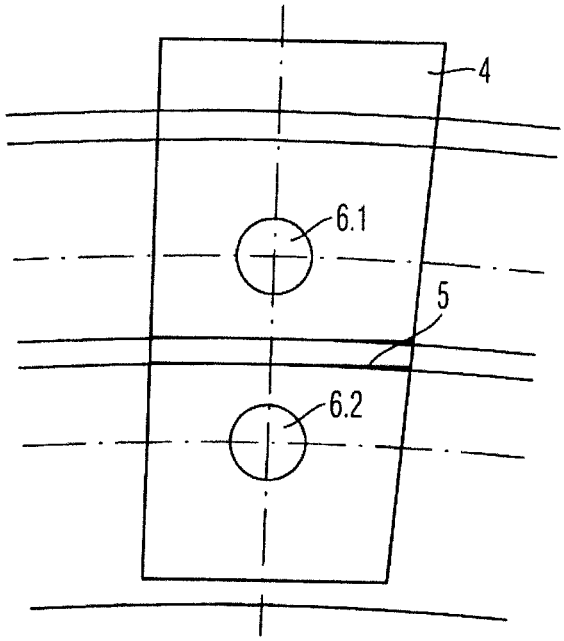
FIG. 5 is a top view of the insertion root according to FIG. 4 in axial direction.

Further, as can be seen from FIG. 5, the front side of the fingers 3, 4 with reference to the rotating direction (in the counterclockwise direction in FIG. 5) is oriented parallel to the radial plane through the centers of the bore holes 6.1, 6.2, while the rear side with reference to the rotating direction is correspondingly rotated in circumferential direction around a blade pitch.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A rotor blade for a flow machine, comprising:

an insertion root comprising:

a first finger;

two second fingers which are arranged on either side of the first finger in axial direction; and a respective shoulder arranged on the first finger and the second finger in axial direction on respective axial sides facing one another such that the first finger and the second fingers have a respective radially outer first portion ($b_{F1}$, $b_{F2}$) and a radially inner second portion whose axial extension ($b_{F3}$) is shorter than that of an outer first portion, wherein, a ratio of a radial height of the first, radially outer portion to a total axial width between axial sides of the two second fingers that face away from one another is in a range of 0.39 to 0.45, and a ratio of the radial height of the second radially inner portion to the total axial width between axial sides of the two second fingers that face away from one another is between 0.40 and 0.46.

2. The rotor blade according to claim 1, wherein the axial sides of the two second fingers facing away from one another are formed without a shoulder.

3. The rotor blade according to claim 2, wherein a ratio of the total radial height of the fingers in relation to the total axial width between axial sides of the two second fingers facing away from one another (h/b) is in a range of 0.88 to 0.94.

4. The rotor blade according to claim 1, wherein the shoulder has a radial height in a range of 0.00 to 0.14, with respect to the total axial width between axial sides of the two second fingers facing away from one another.

5. The rotor blade according to claim 1, wherein the axial width of the shoulder decreases continuously from the first portion to the second portion.

6. The rotor blade according to claim 1, wherein, a ratio of the total axial width between axial sides of the two second fingers facing away from one another, to at least one of the first, radially outer portion of the first finger has an axial extension ($b_{F2}/b$) is in a range between 0.21 and 0.27, and the second, radially inner portion of the first finger has an axial extension ($b_{F3}/b$) is in a range between 0.11 and 0.17.

7. The rotor blade according to claim 1, wherein, a ratio of the total axial width between axial sides of the two second fingers facing away from one another to at least one of the first, radially outer portion of a second finger has an axial extension ($b_{F1}/b$) is in the range is between 0.16 and 0.22, and the second, radially inner portion of a second finger has an axial extension ($b_{F3}/b$) is in the range is between 0.11 and 0.17.

8. The rotor blade according to claim 1, wherein each of the first finger and the second finger have two bore holes which are spaced apart and aligned with one another for accommodating a fastening bolt, wherein, in relation to the total axial width between axial sides of the two second fingers facing away from one another at least one of, the center of a radially outer bore hole has a distance from the radially outer end of the first portion between ($h_{B1}/b$) 0.24 and 0.30, and the center of a radially inner bore hole has a distance from the radially outer end of the first portion ($h_{B2}/b$) between 0.60 and 0.66.

9. The rotor blade according to claim 1, wherein the first finger and the second finger are connected to one another by a radially outer web whose radial height in relation to the total axial width between axial sides of the two second fingers facing away from one another ($h_{F1}/b$) is in a range between 0.12 and 0.18.

10. A flow machine, comprising an insertion root of a rotor blade comprising:

a first finger;

two second fingers which are arranged on either side of the first finger in axial direction; and a respective shoulder arranged on the first finger and the second fingers in axial direction on respective axial sides facing one another such that the first finger and the second fingers have a radially outer first portion and a radially inner second portion whose axial extension ($b_{F3}$) is shorter than that ($b_{F1}$, $b_{F2}$) of an outer first portion, wherein, in relation to a total axial width between axial sides of the two second fingers that face away from one another, a radial height of the first, radially outer portion ($h_{F1}/b$) is in a range of 0.39 to 0.45, and a radial height of the second, radially inner portion ($h_{F2}/b$) is between 0.40 and 0.46; and a groove arrangement for receiving the insertion root, comprising:

a first groove for receiving the first finger;

two second grooves for receiving the second fingers; and webs configured to separate the second grooves from the first grooves by, wherein axial sides facing one another the webs have respective shoulders in axial direction such that the webs have a radially outer, first web portion and a second radially inner web portion whose axial extension ($b_{N2}$) is greater than that of the outer first web portion ($b_{N1}$), wherein, in relation to a total axial width between axial sides of the two second grooves facing away from one another, a radial height of the first, radially outer web portion ($t_{N1}/b$) is in a range between 0.40 and 0.46, and a radial height of the second, radially inner web portion ($t_{N2}/b$) is in a range between 0.44 and 0.50.

11. The flow machine according to claim 10, wherein, in relation to the total axial width between axial sides of the two second grooves facing away from one another, a total radial height (t/b) of the webs is in a range between 0.92 and 0.98.

12. The flow machine according to claim 11, wherein the webs have a respective bevel on at least one of their radially outer front side and their radially inner end.

13. The flow machine according to claim 12, wherein, in relation to a total axial width between axial sides of the two second grooves facing away from one another at least one of, the first, radially outer portion of a web has an axial extension ($b_{N1}/b$) in a range between 0.16 and 0.22, and the second, radially inner portion of a web has an axial extension ($b_{N2}/b$) in a range between 0.26 and 0.32.

14. The flow machine according to claim 13, wherein the grooves are formed substantially complementary to the first and second fingers.

15. The rotor blade according to claim 1, wherein the axial width of the shoulder decreases linearly from the first portion to the second portion.

* * * * *